US012337379B2

(12) United States Patent
Karhausen et al.

(10) Patent No.: US 12,337,379 B2
(45) Date of Patent: Jun. 24, 2025

(54) RELEASE AGENT-FREE ALUMINIUM STRIP CASTING

(71) Applicants: Kai-Friedrich Karhausen, Bonn (DE); Mark Badowski, Siegburg (DE); Wolfgang Müller, Bamberg (DE); Dirk Gade, Koblenz (DE)

(72) Inventors: Kai-Friedrich Karhausen, Bonn (DE); Mark Badowski, Siegburg (DE); Wolfgang Müller, Bamberg (DE); Dirk Gade, Koblenz (DE)

(73) Assignee: Speira GmbH, Grevenbroich (DE)

( * ) Notice: Subject to any disclaimer, the term of this patent is extended or adjusted under 35 U.S.C. 154(b) by 0 days.

(21) Appl. No.: 18/344,140

(22) Filed: Jun. 29, 2023

(65) Prior Publication Data

US 2023/0339014 A1 Oct. 26, 2023

Related U.S. Application Data

(63) Continuation of application No. PCT/EP2021/086408, filed on Dec. 17, 2021.

(30) Foreign Application Priority Data

Jan. 5, 2021 (EP) ..... 21150174

(51) Int. Cl.
*B22D 11/06* (2006.01)
*B22D 11/00* (2006.01)

(52) U.S. Cl.
CPC ..... *B22D 11/0674* (2013.01); *B22D 11/003* (2013.01); *B22D 11/0605* (2013.01);
(Continued)

(58) Field of Classification Search
CPC ..... B22D 11/00; B22D 11/003; B22D 11/06; B22D 11/0605; B22D 11/0622; B22D 11/0651; B22D 11/0654; B22D 11/0674
(Continued)

(56) References Cited

U.S. PATENT DOCUMENTS 4,054,173 A * 10/1977 Hickam ..... B22D 11/0622 164/428
2003/0029599 A1* 2/2003 Poirier et al. ..... B22D 11/0651 164/428

(Continued)

FOREIGN PATENT DOCUMENTS

CN 1294536 A 5/2001
CN 103260897 A 8/2013

(Continued)

OTHER PUBLICATIONS

Rapid Solidification Technology and Materials; Yuezhu Li, National Defense Industry Press; 3 pages; Published Nov. 30, 1993.

(Continued)

*Primary Examiner* — Kevin P Kerns
(74) *Attorney, Agent, or Firm* — Reinhart Boerner Van Deuren P.C.

(57) ABSTRACT

A casting roller or belt for a revolving chill mould of a strip casting system is provided for the manufacture of an aluminium alloy strip. The strip casting system for manufacturing the aluminium alloy strip includes at least one such revolving chill mould with a casting gap. In the casting roller or belt of the strip casting system, adhesion to the casting roller or belt is avoided during strip casting, and a low-segregation and crack-free aluminium alloy strip can be produced under industrial conditions. This is achieved by utilizing a specific surface structure of the casting roller or belt in which a roughness value Sa is more than 5 μm and an average peak count RPc (0.5 μm) is less than 42 $cm^{-1}$.

20 Claims, 5 Drawing Sheets

(52) U.S. Cl.
CPC ..... *B22D 11/0622* (2013.01); *B22D 11/0651* (2013.01); *B22D 11/0654* (2013.01)

(58) Field of Classification Search
USPC ..... 164/480, 428
See application file for complete search history.

(56) References Cited

U.S. PATENT DOCUMENTS

| | | | | |
|---|---|---|---|---|
| 2010/0300643 | A1 | 12/2010 | Albrecht-Frueh et al. | |
| 2013/0251945 | A1* | 9/2013 | Bay et al. | B29C 39/14 264/495 |

FOREIGN PATENT DOCUMENTS

| | | | |
|---|---|---|---|
| CN | 104002202 | A | 8/2014 |
| CN | 104002203 | A | 8/2014 |
| CN | 105358727 | A | 2/2016 |
| CN | 106272087 | A | 1/2017 |
| CN | 107995881 | A | 5/2018 |
| EP | 0736350 | A1 | 10/1996 |
| JP | 2017177142 | A | 10/2017 |
| KR | 20040056771 | A | 7/2004 |
| KR | 100928768 | B1 | 11/2009 |

OTHER PUBLICATIONS

Material Science and Engineering Research Progress, vol. 1; Mingtu Ma, Wei Sha, China Machine Press; 2 pages; Published Sep. 30, 2000.

* cited by examiner

RELEASE AGENT-FREE ALUMINIUM STRIP CASTING

CROSS-REFERENCE TO RELATED PATENT APPLICATIONS

This patent application is a continuation of International Application No. PCT/EP2021/086408, filed on Dec. 17, 2021, and which claims the benefit of priority to European Patent Application No. 21150174.7, filed Jan. 5, 2021, the entire teachings and disclosures of the aforementioned applications are incorporated herein by reference thereto.

FIELD OF THE DISCLOSURE

The invention relates to the use of a casting roller or belt for a revolving chill mould of a strip casting system for manufacturing an aluminium alloy strip; as well as to the use of a strip casting system for manufacturing an aluminium alloy strip comprising at least one revolving chill mould with a casting gap. The invention further relates to a method for manufacturing an aluminium alloy strip using a strip casting system.

BACKGROUND OF THE INVENTION

Strip casting by means of strip casting systems is an economical and energy-efficient alternative to the conventional production of metal strips by means of ingot casting, reheating and hot rolling. In strip casting, a hot strip is produced close to the final dimensions directly from a metal melt. For this purpose, the metal melt is cast in a strip casting system in which the casting region or solidification region, in which the cast strip is formed, is delimited on at least one longitudinal side by a barrier which is continuously moved and cooled during the casting process. This barrier runs with the solidifying strip, so that a so-called revolving chill mould is provided thereby. Revolving chill moulds allow a high casting and solidification speed. Due to the required widths of metal strips and further efficiency improvements, casting-rolling by means of a twin-roll casting (TRC) process has, on the one hand, become established in the aluminium industry. In this case, the metal melt is introduced in particular into an internally-cooled roller pair or roll pair and first solidifies in the casting gap between the two rollers, is then re-shaped, removed as a strip and wound up, for example. Such a strip casting system is known, for example, from WO 2004-000487. On the other hand, the mostly horizontally-operated twin-belt casting process (TBC or Hazelett process) has become established, in which the revolving chill mould is formed by opposite sides of two cooled (dam block) belts, between which a casting gap is formed, in which the metal melt solidifies. In the belt process, revolving chill moulds in the form of caterpillar chill moulds (block casting) are also used, in which cooling blocks are arranged on belt segments. Various casting rollers for steel strip manufacturing are known, for example, from CN 104 002 202 A, CN 104 002 203, CN 106 272 087, US 2010/0300643 and EP 0 736 350 A1. A casting roller suitable for non-ferrous metals for a corresponding strip casting system is known from KR 100 928 768 B1, which has a ground surface with an average roughness Ra of less than 5 μm. A casting roller whose surface has a roughness Ra of 0.1 μm to 2.0 μm is known from the Japanese patent application JP2017177142 A.

Problematic in the manufacture of aluminium strips using strip casting processes is the adherence of the strip to the chill mould surface. At the start of the strip formation process, the melt comes into contact with the chill mould. Solidification seeds form at the contact points. The solidification seeds grow into solidification lenses, which then combine to form continuously growing strip shells. The resulting two continuously growing strip shells are subsequently joined in a re-shaping process to form a strip. The contact of the melt or the hot strip surface with the revolving chill mould under high pressure, which contact is present in this process, leads, on the one hand, to the welding of the two strip shells, but, on the other hand, to undesired adhesions or weldings of the strip surface with the revolving chill mould. This can lead to hot cracks on the strip surface or to inhomogeneities in the strip structure and thus to adverse material properties of the strip. In the worst case, the adhesions can lead to strip breaks and thus to process interruptions.

For this reason, a release agent is applied in TRC and TBC processes to prevent adhesion; in the case of the in particular horizontal TRC, a graphite suspension is mostly used. In the TBC process, permanent coatings are additionally applied to the circulating belt. In the TRC process, smooth-ground casting rollers are generally used.

The use of a release agent is a significant limiting factor for the productivity of the strip casting processes and can lead to quality restrictions. For example, the use of a release agent can lead to undesirable deposits on the produced strips.

SUMMARY OF THE INVENTION

The present invention therefore has the object of providing the use of a casting roller or belt with which, on the one hand, adhesion to the casting roller or belt is avoided and, on the other hand, a low-segregation and crack-free aluminium alloy strip can be produced, in particular under industrial conditions. Furthermore, the present invention has the object of providing a corresponding use of a strip casting system for manufacturing an aluminium alloy strip and a corresponding method for strip casting.

The object pointed out is achieved by the use according to the present disclosure as well as with a method according to the present disclosure.

According to a first teaching, this object is achieved by the use of a casting roller or belt according to the invention in that the surface of the casting roller or belt has a roughness value Sa of more than 5 μm and an average peak count RPc(0.5 μm) of less than 42 $cm^{-1}$.

The surface of the casting roller or belt refers here to the surface which during strip casting comes into contact with the melt or an oxide layer surrounding it, i.e. typically the circumferential surface of the roller or belt. In the case of a casting belt in the form of a caterpillar chill mould, the surface of the belt is therefore to be understood as the corresponding surface of the cooling blocks.

To structure the surface of the casting roller or belt, a shot blasting texturing (SBT) process can be used. Preferably, the surface structure of the casting roller or belt is created by shot blasting. A blasting agent is thereby applied to the surface via a centrifugal wheel or via compressed air at pressures of 2 to 7 bar. For example, steel, glass or plastic balls are used as blasting agents, for example with a diameter in the range of 1 to 5 mm. Another advantage of this process is that the surface is re-shaped and thus a hardening is introduced, which contributes to the surface becoming more wear-resistant in use.

Conventionally, ground casting rollers are used as described above. Typically, a conventional casting roller ground in this way only has an average roughness in the range of up to a few micrometres. However, the inventors have recognised that, surprisingly, the use of a rough surface in particular can have advantages in terms of preventing adhesions. In particular, an oxide layer formed on the melt, which can develop very quickly, particularly in the case of aluminium melts, can also be used to significantly reduce an adhesion of the melt, the strip shells or the strip to the casting roller or belt. Even at a roughness value Sa of more than 5 μm and an average peak count RPc(0.5 μm) of less than 42 $cm^{-1}$, adhesion to the casting roller or belt can be avoided, since the contact area with the melt is reduced by correspondingly finely formed peaks.

In a next configuration of the casting roller or belt, the surface of the casting roller or belt has a roughness value Sa of more than 15 μm and/or an average peak count RPc(0.5 μm) of less than 35 $cm^{-1}$ Preferably, the average peak count RPc(0.5 μm) is at least 9 or preferably at least 10 $cm^{-1}$ in order to achieve a preferred peak spacing and to largely prevent contact of the melt or the oxide skin on the melt with the roller primer. The peaks are preferably stochastically distributed and preferably have a height of at least 10 μm. Sa is, in turn, for example, at most 70 μm.

Due to a rougher surface and/or a lower peak count, the surface tension of the aluminium alloy melt can be better utilised so that contact of the melt or the oxide layer surrounding it with the casting roller or belt only takes place at roughness peaks and thus adhesion to the casting roller or belt is even better avoided. Thus, the first contact of the melt with a revolving chill mould, for example the surface of a casting roller or belt, takes place at the roughness peaks, at which the first solidification seeds are consequently formed. An optimal interplay of roughness and average peak count enables statistically sufficient contact points to be provided to ensure that the surface tension of the melt is sufficient to effectuate contact only at the roughness peaks. Since release agents and thus an additional barrier for the heat flow can be dispensed with, heat dissipation takes place directly via the roughness peaks when the melt solidifies. By utilising this stabilising function of the oxide layer, the solidification of the strip shells can be homogenised and the quality of an aluminium strip produced in this way can be improved.

In a further configuration of the casting roller or belt, the surface of the casting roller or belt has a surface structure which, in an Abbott-Firestone curve (measured thereon), at an area proportion $S_{mr}$ of 10% has a height value c of at least 20 μm above the zero level, wherein the zero level is defined as the height value at an area proportion of 50%, i. e. c(10%)≥20 μm, if c(50%):=0 μm. Preferably, the surface of the casting roller or belt has a surface structure which, in an Abbott-Firestone curve (measured thereon), at an area proportion $S_{mr}$ of 10% has a height value c of at least 25 μm above the zero level, wherein the zero level is defined as the height value at an area proportion of 50%, i. e. c(10%)≥25 μm, if c(50%):=0 μm.

These properties lead to a low bearing proportion with a high profile height. A correspondingly structured surface has deep pockets, i.e. empty volumes, so that the contact area between the melt and the casting roller or belt is reduced. Furthermore, gas can be enclosed in the empty volume between the melt and the surface of the casting roller or belt, which contributes to stabilising the oxide layer, such that the heat dissipation in the strip growth phase is reduced and homogenised. An oxygen-containing gas mixture, such as air, is suitable for this purpose, for example, which can ensure constant oxidation of the surface of the melt in the boundary layer. Thereby, the oxide layer on the strip shell surface can be stabilised, which prevents adhesion. Advantageously, the surface of the casting roller or belt has a closed empty area proportion αclm of at least 30%.

To obtain the Abbott-Firestone curve, a surface typically is optically measured three-dimensionally. Planar areas extending parallel to the measured surface are introduced at a height c into the measured three-dimensional height profile of the surface, where c is preferably determined as the distance to the zero level of the measured surface. The area content of the sectional area of the introduced planar areas with the measured surface at the height c is determined and divided by the entire measuring area in order to obtain the area proportion of the sectional area on the total measuring area. This area proportion is determined for different heights c. The sectional area height is then represented as a function of the area proportion, which results in the Abbott-Firestone curve. Thus, this describes the material proportion of the surface depending on the height of a sectional area through the surface.

In particular in connection with a roughness value Sa of more than 15 μm and a peak count RPc(0.5 μm) of less than 35 $cm^{-1}$, a constant contact area between melt and casting roller or belt can be enabled until a stable strip shell is formed, since the oxide layer surrounding the melt only directly touches the casting roller or belt at roughness peaks due to the surface tension of the melt and these contact areas are retained during the formation of the solidification lenses and the strip shells.

In a further configuration of the casting roller or belt, the surface of the casting roller or belt has a roughness value Sa of 5 to 40 μm, preferably 15 to 30 μm, further preferably 20 to 25 μm. These regions ensure an improvement of the roughness properties of the casting roller surface with regard to the aforementioned properties for the avoidance of melt adhesions.

In a further configuration of the casting roller or belt, the surface of the casting roller or belt is substantially isotropic in terms of the peak count, wherein the ratio RPc in the X direction to RPc in the Y direction has the value 1±5%, and the X direction and Y direction are perpendicular to one another.

Isotropy with regard to the peak count can be determined by the ratio of the peak count in the X and Y direction. The X and Y directions are determined by the two sides of the rectangular measuring area. The expression 'substantially isotropic' means that a deviation of 5% is permitted, i.e. that the ratio RPc (in X direction) to RPc (in Y direction)=1 (±5%).

The surface is preferably isotropic with regard to Sa and RPc, particularly preferably the surface is substantially isotropic, i.e. with regard to all relevant parameters.

Due to the surface being isotropic in this manner, a particularly advantageous homogeneous solidification of the melt and thus a particularly high-quality aluminium alloy strip can be manufactured.

In a further configuration of the casting roller or belt, the surface of the casting roller or belt has been subjected to a grinding with a removal of up to 45 μm, preferably between 30 and 40 μm, particularly preferably from 33 to 37 μm, in particular 35 μm, after structuring. In this case, after the advantageous structuring mentioned above, a grinding of the surface of the casting roller or belt is carried out. This leads to an improvement of the wear resistance of the surface. The peaks are ground down somewhat so that plateaus are formed, which can support the melt particularly well, while at the same time retaining the advantageous properties mentioned. Advantageously, the bearing proportions form an isotropic net-shaped structure.

In a further configuration of the casting roller or belt, at least the surface of the casting roller or belt has a material with a thermal conductivity of more than 100 W/(m*K), in particular of more than 200 W/(m*K), preferably of more than 300 W/(m*K).

By using such a material, the temperature of the melt or strip shell in the region of the direct contact can be reduced very quickly and thus adhesions or weldings can be avoided even better. For example, a copper alloy is suitable as a material. Advantageously, the casting roller or belt has this material from the surface up to the inner cooling channels. In particular, the casting roller or belt consists substantially of a corresponding copper alloy.

According to a second teaching, the object is also achieved by the use of a strip casting system for manufacturing an aluminium alloy strip comprising at least one revolving chill mould with two revolving barriers, between which a casting gap is formed, wherein in particular at least one revolving barrier is provided by a casting roller or belt, in that the surface of at least one revolving barrier has a roughness value Sa of more than 5 μm and an average peak count RPc(0.5 μm) of less than 42 cm'. A surface structured in this way can be regarded as a means for transporting an oxide layer, in particular from the surface of a melt pool formed in front of the revolving chill mould into the casting gap. Thus, the at least one revolving chill mould of the strip casting system in particular has at least one casting roller or belt according to the invention.

Thereby, advantageous properties already described can be implemented. For example, an oxide layer formed on the surface of the melt pool can be used for manufacturing aluminium alloy strip without release agents. In particular, a substantially unbroken oxide layer can be drawn from the surface of the melt pool into the casting gap in a controlled and continuous manner. The drawn-in oxide layer then advantageously forms a separating layer between the chill mould wall, for example a roller, and the aluminium melt.

According to a further configuration of the strip casting system, the surface of the at least one revolving barrier has a roughness value Sa of more than 15 μm and/or an average peak count RPc(0.5 μm) of less than 35 cm'.

According to a further configuration of the strip casting system, the surface of the at least one revolving barrier has a surface structure which, in an Abbott-Firestone curve (measured thereon), at an area proportion $S_{mr}$ of 10% has a height value c of at least 20 μm above the zero level, wherein the zero level is defined as the height value at an area proportion of 50%. Due to the low bearing proportion at a high profile height, a stabilisation or continuous renewal of the oxide layer on the melt surface in the boundary layer of melt and revolving chill mould can be achieved, for example by introducing an oxygen-containing gas mixture into this boundary layer. As a result, a stationary state can be formed between the reforming oxide layer and the drawn-in oxide layer. In particular, it may be advantageous to even actively control the formation of the oxide layer by supplying oxygen.

Preferably, the barrier has a closed empty area proportion of at least 30%. As a result, the heat dissipation can be homogenised by stabilising a gas layer, for example air, in the boundary layer.

According to a further configuration of the strip casting system, the surface of the at least one revolving barrier is substantially isotropic in terms of the peak count. This leads to already described advantageous properties for the quality of a manufactured aluminium alloy strip.

According to a further configuration of the strip casting system, the surface of the at least one revolving barrier has an area-related roughness value Sa of 5 to 40 μm, preferably 15 to 30 μm, further preferably 20 to 25 μm.

In a next configuration of the strip casting system, the strip casting system has means for setting the composition of an atmosphere on the surface of the revolving chill mould. Thus, a certain gas mixture, for example, can be introduced into the intermediate layer between melt and revolving chill mould. Preferably, an oxygen-containing gas, for example air or a gas mixture with an increased oxygen content, is used in order to support the constant reforming or stabilisation of an oxide layer. For example, a gas mixture can be applied to the surface of the melt pool via a nozzle. A gas mixture can also be targetedly introduced by means of a nozzle into the contact region between melt and revolving barrier, such that it can be enclosed in the empty volume between melt and the surface of the casting roller or belt. For example, the oxygen content in the gas mixture can be adjusted in order to control the formation of an oxide layer on the surface of the melt or strip.

Preferably, the strip casting system has means for setting a specific area load, when joining strip shells, from 10 to 800 kN/m, preferably from 20 to 400 kN/m, further preferably from 100 to 200 kN/m.

In a next configuration of the strip casting system, the strip casting system is a vertical or horizontal strip casting system. It has been found that the surface structure provided according to the invention can be used particularly advantageously for vertically or horizontally aligned strip casting systems, in particular TRC systems.

In a further configuration of the strip casting system, the strip casting system comprises means for supplying an aluminium alloy melt into a melt pool formed in front of the casting gap, via which the aluminium alloy melt can be supplied to the melt pool below the surface of the melt pool. For example, the strip casting system has a casting region arranged in front of the casting gap and comprises means for supplying an aluminium alloy melt into the casting region, via which an aluminium alloy melt can be supplied to the casting region below the surface of a melt pool formed in the casting region.

The casting region is arranged in front of the revolving chill mould and is generally delimited by the revolving chill mould. The casting region can be designed as a casting gusset, wherein the casting region or the casting gusset is formed by the revolving chill mould and at least one side dam, preferably two side dams, which are attached opposingly at both sides of the revolving chill mould. In the casting region, during the manufacture of a metal strip, a melt pool is formed from which aluminium alloy melt flows and/or is drawn into the roller gap. In the case of vertical strip casting systems, the casting region or casting gusset is arranged substantially above the casting gap and delimited by the upper region of the revolving chill mould. If means for supplying the metal melt into the casting region are configured such that the aluminium alloy melt can be supplied to the casting region below the surface of a melt pool, the surface of the melt pool can be kept particularly calm. A breakthrough of the surface of the melt pool, for example due to turbulence of the surface, is avoided in this case such that unregulated reforming of oxides or mixing in of oxides can be effectively prevented. It can also be prevented that a formed oxide layer is drawn into the casting gap and mixed in in an uncontrolled manner. Instead, an unbroken oxide layer of uniform thickness can be provided on the surface of the melt pool. For example, via a casting roller with a surface structure already described, this unbroken oxide layer of the melt pool can then be drawn into the casting gap in a controlled and continuous manner. The drawn-in oxide layer then already advantageously forms a separating layer between the chill mould wall, for example a roller or a cooling strip, and the aluminium alloy melt.

According to a third teaching, the object is achieved by a method for manufacturing an aluminium alloy strip using a strip casting system according to the invention, which comprises the following steps:

- forming a melt pool of an aluminium alloy melt in a casting region in front of the revolving chill mould;
- stabilising an oxide layer on the surface of the melt pool by applying an oxygen-containing gas mixture, for example air, to the melt;
- drawing the oxide layer into the casting gap;
- preferably setting a specific area load, when joining the strip shells forming during the solidification of the melt, from 10 to 800 kN/m, preferably from 20 to 400 kN/m, further preferably from 100 to 200 kN/m.

Thereby, as already described, a high-quality aluminium alloy strip, for example made of an AA8xxx alloy, in particular made of an AA8111 alloy, can advantageously be manufactured without release agents. In particular by setting a low specific area load, tearing of the oxide layer and unregulated mixing of oxides into the melt can also be avoided. On the one hand, this can prevent the melt from adhering to the casting roller or belt even better. On the other hand, defects in the manufactured aluminium strip can be avoided, which could result from an unregulated mixing in of oxides during strip casting.

BRIEF DESCRIPTION OF THE DRAWINGS

Further configurations and advantages of the invention can be inferred from the following detailed description of a number of exemplary embodiments of the present invention, in particular in combination with the drawing. The drawing shows in.

DETAILED DESCRIPTION

Figure 1:
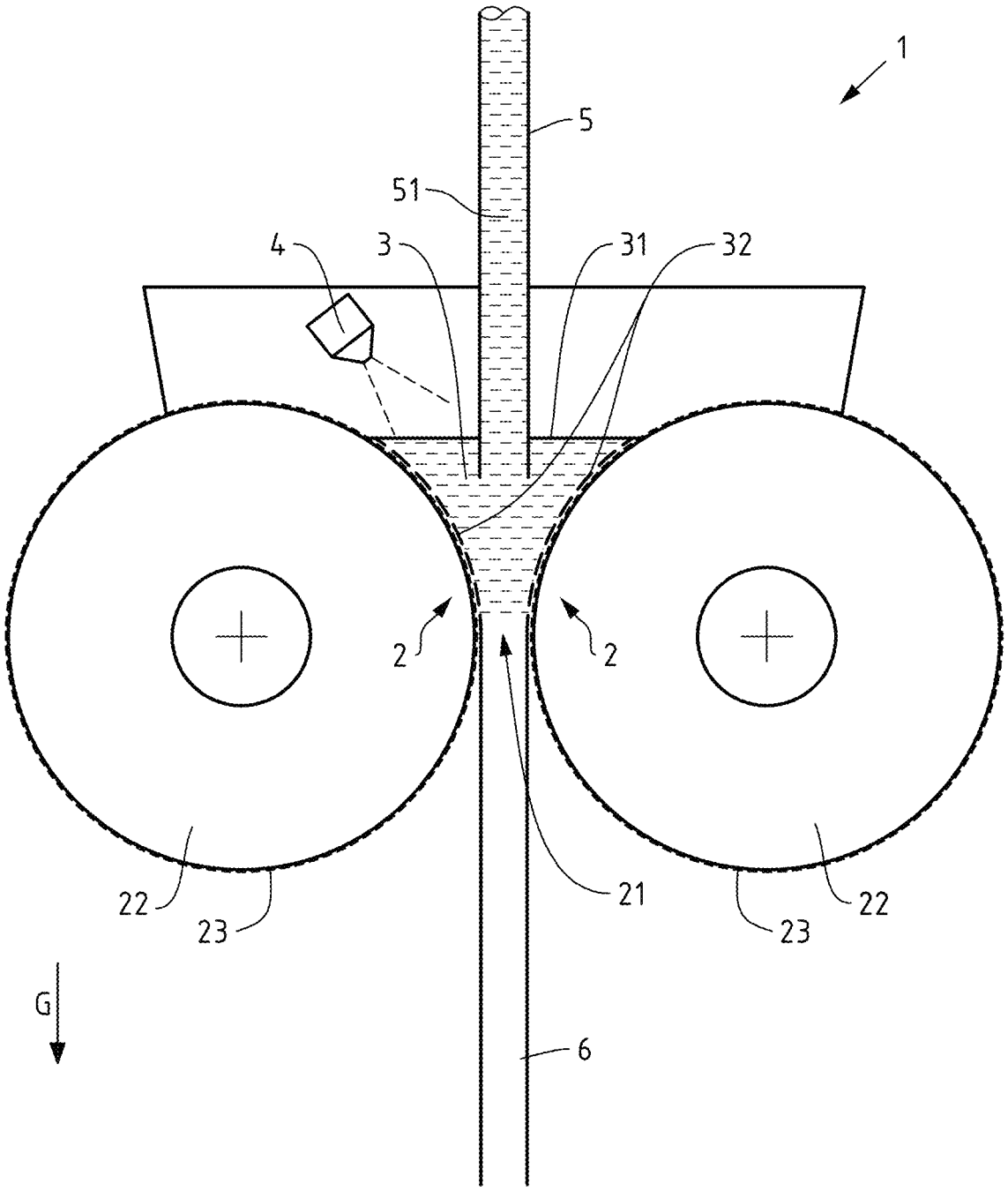
FIG. 1 is a schematic sectional view of an exemplary embodiment of a vertical strip casting system according to the invention.

FIG. 1 shows a strip casting system 1 for manufacturing an aluminium alloy strip 6 comprising a revolving chill mould 2 with two revolving barriers, between which a casting gap 21 is formed, wherein the revolving barriers are in each case provided by a casting roller 22, i. e. the strip casting system 1 comprises a revolving chill mould 2 with a casting gap 21, wherein the revolving chill mould 2 has two casting rollers 22. The surface 23 of the casting roller 22 has a roughness value Sa of more than 15 μm and a peak count RPc(0.5 μm) of less than 35 $cm^{-1}$. In addition, the surface 23 of the casting roller 22 has a surface structure which, in an Abbott-Firestone curve (measured thereon), at an area proportion $S_{mr}$ of 10% has a height value c of at least 20 μm above the zero level, wherein the zero level is defined as the height value at an area proportion of 50%, i. e. c(50%):=0 μm and c(10%)≥20 μm. The surface 23 of the casting roller 22 can also have a roughness value Sa of 5 to 40 μm, preferably 15 to 30 μm. The surface 23 of the casting roller 22 is substantially isotropic in terms of the peak count with a ratio of Rpc (in X direction) to Rpc (in Y direction) =1(±5%). The casting roller 22 consists of a copper alloy having a thermal conductivity of more than 300 W/(m*K), which is effective from the surface up to the inner cooling channels. After the corresponding structuring, the surface 23 of the casting roller 22 can be subjected to a grinding with 35 μm removal. The strip casting system 1 also has means 4 for setting the composition of an atmosphere on the surface of the revolving chill mould 2 and/or the surface 31 of the melt pool 3. The means 4 allow a controlled application of an oxygen-containing gas mixture, for example air, to the corresponding surfaces.

A casting furnace is connected to the casting gusset here by a pipe system which comprises heatable ceramic pipes 5. Furthermore, the casting gusset has two side dams. The aluminium alloy melt is guided from above into the casting gusset through a supply pipe 51. The supply pipe 51 can in this case be designed as means for supplying the aluminium alloy melt into the casting gusset, via which the aluminium alloy melt can be supplied to the casting region below the surface of the melt pool 3 formed in the casting region. For example, the outflow opening of the supply pipe 51 can lie below the surface of the melt pool.

As a result, the unbroken oxide layer formed on the surface 31 of the melt pool 3 can be drawn into the casting gap 21 in a casting direction G in a controlled and continuous manner. The drawn-in oxide layer 32 then advantageously forms a separating layer between the chill mould wall and the melt or the removed aluminium alloy strip 6. Advantageously, this oxide layer can be drawn into the casting gap 21 undamaged and can thus serve as a separating layer between the melt and the casting roller or casting roll, whereby abrasion is avoided and a uniform and clean surface of the produced aluminium alloy strip 6 can be achieved after strip casting.

The mentioned parameters, as well as the Abbott-Firestone curve, are typically determined by optical measurement of the 3D surface structure. The optical capture of the surface takes place, for example, areally via interferometry or preferably confocal microscopy. The measuring area must be chosen large enough to ensure a statistically representative measurement of the surface. For example, in the present roughness range, a preferably square measuring area with a side length of 7 mm each can be used. The lateral measuring point distance must be selected such that sufficient resolution of the individual surface characteristics is given, e.g. 1.6 μm. The roller curvature contained in the raw data of the measurement is removed by means of an F-operator (2nd order polynomial). The determination of the roughness value Sa and of the areal material proportion Smr based on the Abbott-Firestone curve is carried out in accordance with DIN-EN-ISO 25178-2:2012. The peak count RPc can also be determined from the optical measurement of the 3D surface structure by evaluating in each case the profile along a line, for example along or parallel to one of the sides of the measuring area, and by determining, starting from these line profiles, the mean peak count RPc of the surface following DIN EN 10049:2005 (application group 1—but without further removal of the ripple and fine roughness proportions). The use of RPc as a characteristic value has proven to be advantageous in the topographies presented here. A ripple filter is not used, as it would require, on the one hand, impractically large measuring areas at the very high roughness. On the other hand, the long waves are insignificant for the contact conditions of the aluminium melt on a casting roll or belt.

Measurement and evaluation are usually carried out with corresponding standard-compliant software.

Figure 2A:
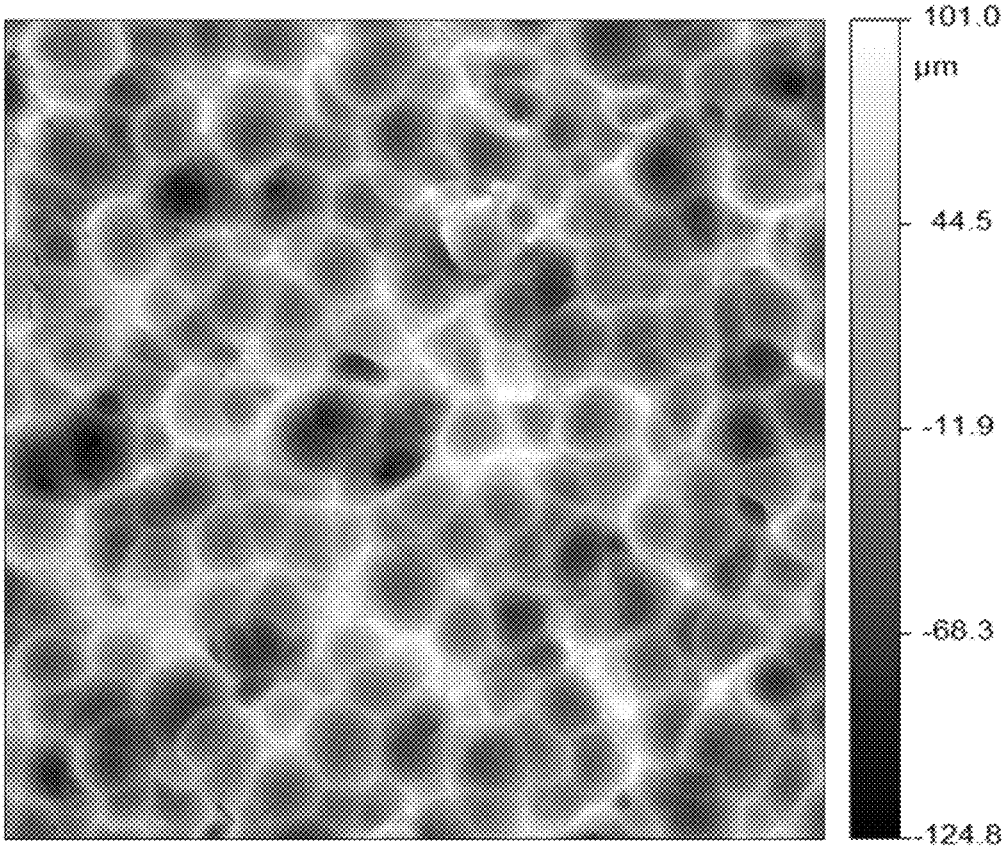
FIG. 2*a* is a surface section of an exemplary embodiment of a casting roller according to the invention.

FIG. 2*a* shows a representation of a square measuring region of X=7 mm and Y=7 mm, which was determined on the surface of an exemplary embodiment of a casting roller according to the invention by means of optical 3D measurement. The casting roller thereby had a copper surface.

Figure 2B:
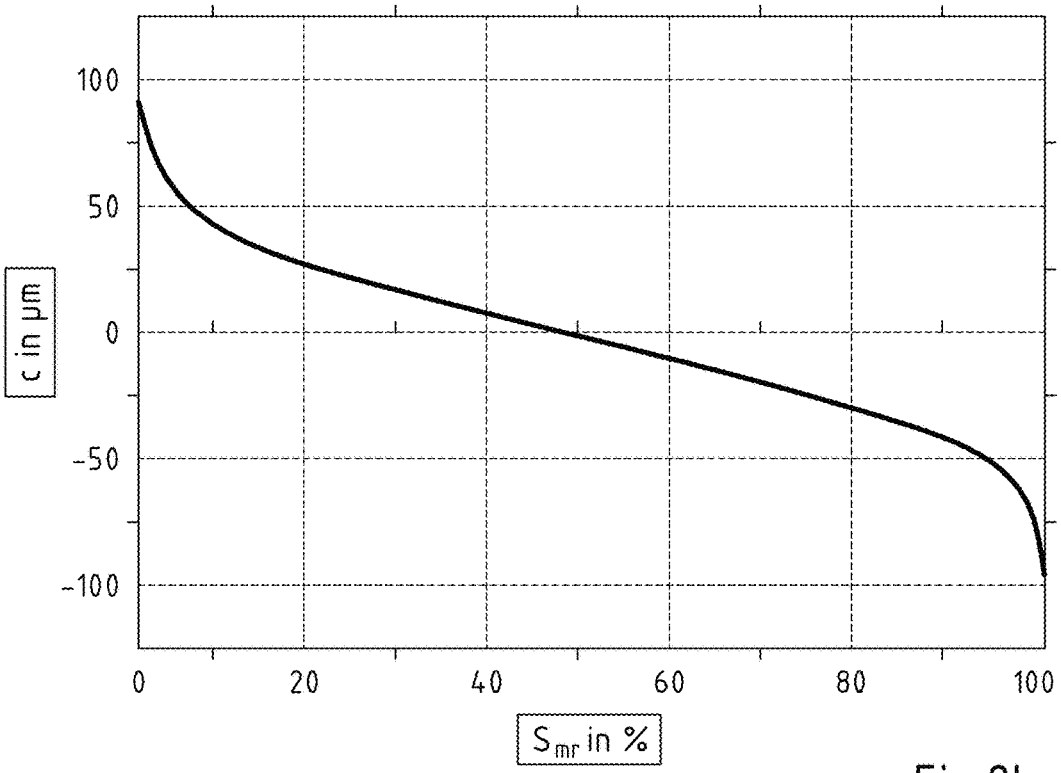
FIG. 2*b* is an Abbott-Firestone curve of the surface of an exemplary embodiment of a casting roller according to the invention.

The associated Abbott-Firestone curve $S_{mr}$(c) measured on the surface of this exemplary embodiment of a casting roller according to the invention is plotted in FIG. 2*b*. This curve is the cumulative probability density function of the surface height profile S(c). It provides, for a percentage value $S_{mr}$ (area proportion) between 0 and 100% (plotted on the abscissa), the profile height c (sectional area position) above which the corresponding percentage proportion of the surface is located. It thus describes the material proportion of the surface depending on the height c of a sectional area through the surface.

From the Abbott-Firestone curve of FIG. 2*b*, it can be clearly seen that the zero level is defined as the height value at an area proportion of 50% and that an area proportion $S_{mr}$ of 10% has a height value c of at least 20 μm above the zero level, wherein the zero level is defined as the height value at an area proportion of 50%.

From the optical 3D measurement of the surface on a square measuring region of X=7 mm and Y=7 mm carried out to determine the Abbott-Firestone curve, a 2D evaluation was also carried out in each case along the X and Y direction to determine the size of the average roughness Ra, the peak count RPc (0.5 μm), the square average roughness value Rq and the average roughness depth Rz. This was done automatically along a large number of lines, each parallel to the sides of the measuring region. An average roughness Ra of 26.4(±5.1) μm, a mean square average roughness value Rq of 32.1(±5.5) μm, an average roughness depth Rz of 104.1 (±13.0) μm and a peak count RPc(0.5 μm) of 17.0(±5.1) per cm resulted along the X direction. An average roughness Ra of 26.4(±2.9) μm, a mean square average roughness value Rq of 32.4(±3.2) μm, an average roughness depth Rz 104.8 (±9.8) μm and a peak count RPc(0.5 μm) of 17.4(±4.4) per cm resulted along the Y direction. In particular, Ra along the X direction is equal to Ra along the Y direction and, due to the isotropy, in particular is equal to the roughness value Sa of 26.4(±2.9) μm. The ratio RPc (in X direction) to RPc (in Y direction)=0.98. The surface is in particular isotropic in terms of RPc, Ra and Rz.

When strip casting an AA8111 alloy with a casting roller, which had the surface characteristics represented in FIGS. 2*a* and 2*b*, good strip formation properties could be achieved.

Figure 3A:
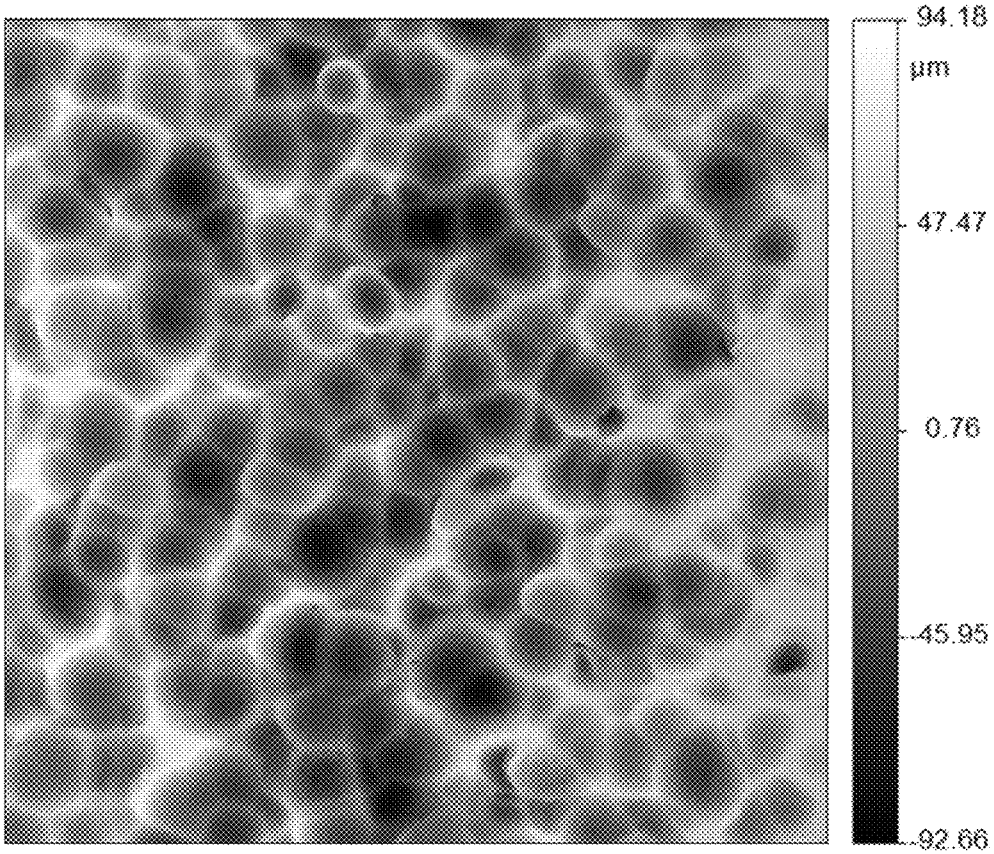
FIG. 3*a* is surface section of an exemplary embodiment of a casting roller according to the invention.
Figure 3B:
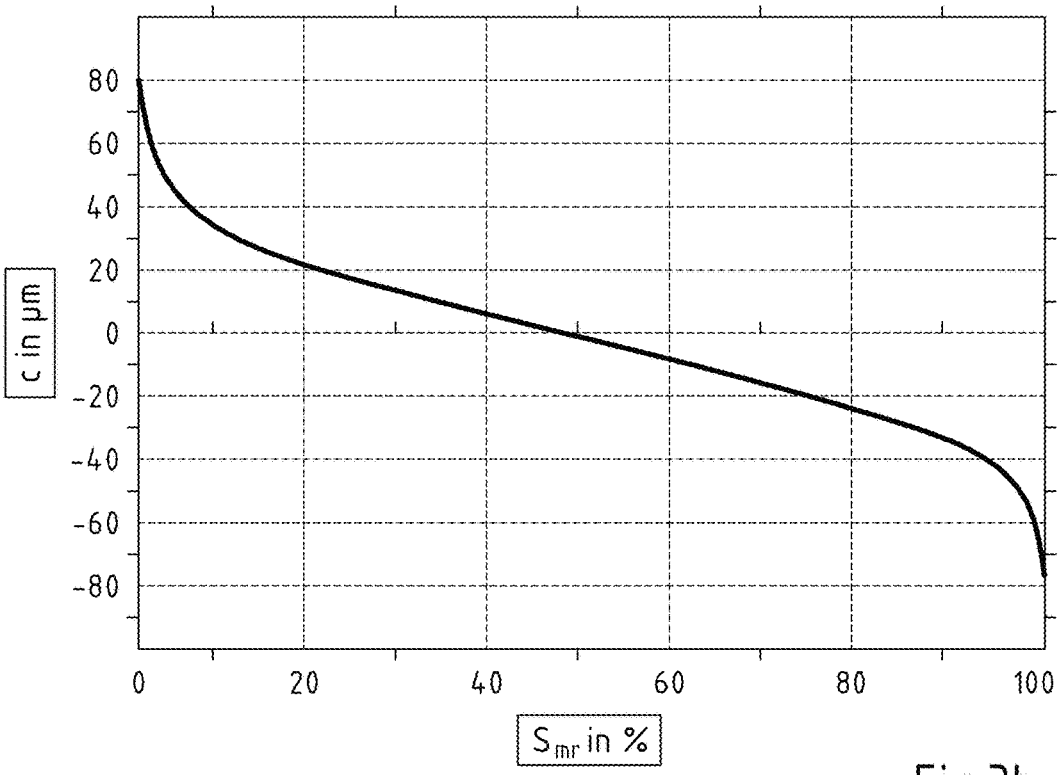
FIG. 3*b* is an Abbott-Firestone curve of the surface of an exemplary embodiment of a casting roller according to the invention.

The copper surface of a further exemplary embodiment of a casting roller according to the invention is exemplarily reflected in FIG. 3*a* by a representation of a square measuring region of X=7 mm and Y=7 mm. The associated Abbott-Firestone curve $S_{mr}$(c) of this further exemplary embodiment is plotted in FIG. 3*b*. The Abbott-Firestone curve of FIG. 3*b* also shows a height value c of at least 20 μm above the zero level at an area proportion $S_{mr}$ of 10%. The optical 3D measurement of the surface carried out to determine the Abbott-Firestone curve was also used to determine the variables calculated for the exemplary embodiment of FIG. 2*a/b*. An average roughness Ra of 23.5(±2.9) μm, a mean square average roughness value Rq of 28.6(±3.5) μm, an average roughness depth Rz of 92.6 (±11.2) μm and a peak count RPc(0.5 μm) of 16.1(±5.1) per cm resulted along the X-direction. An average roughness Ra of 23.8(±3.5) μm, a mean square average roughness value Rq of 28.9(±4.2) μm, a mean roughness depth Rz of 92.7 (±14.3) μm and a peak count RPc(0.5 μm) of 16.1(±4.0) per cm resulted along the Y direction. A roughness value Sa of 23.6(±2.3) μm resulted. Also when strip casting an AA8111 alloy with a casting roller, which had the surface characteristics represented in FIGS. 3*a* and 3*b*, good strip formation properties could be achieved.

Figure 4A:
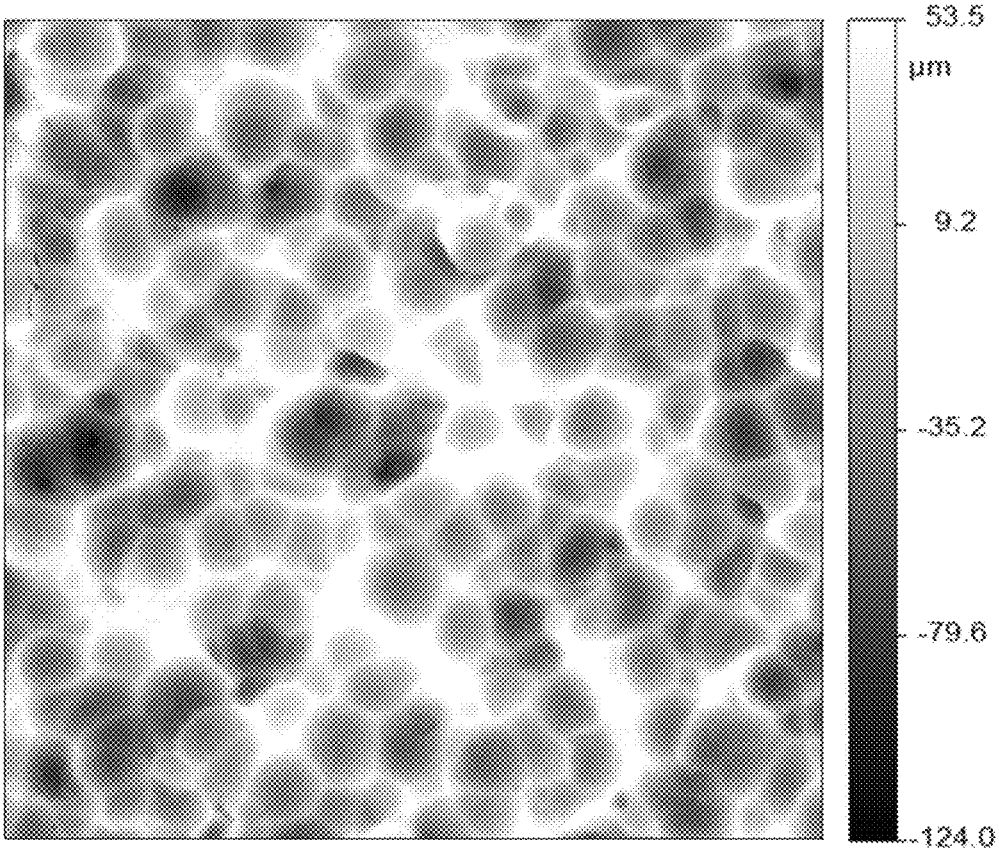
FIG. 4*a* is a surface section of an exemplary embodiment of a casting roller according to the invention.
Figure 4B:
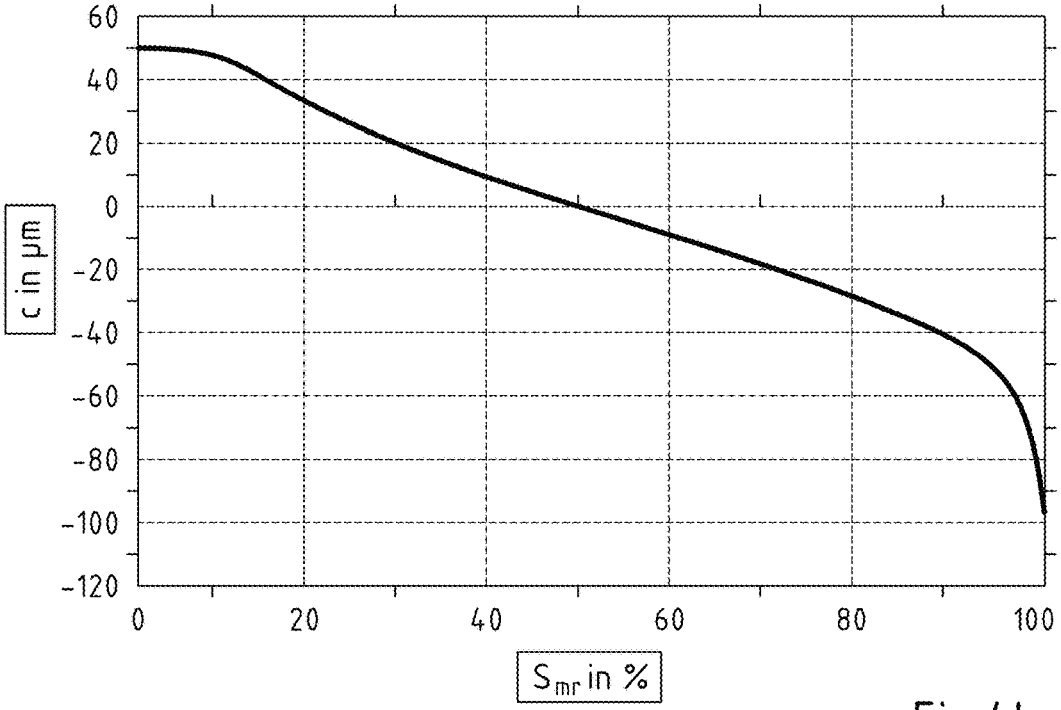
FIG. 4*b* is an Abbott-Firestone curve of the surface of an exemplary embodiment of a casting roller according to the invention.

FIG. 4*a* shows a square region with 7 mm edge length of the surface of a further exemplary embodiment of a casting roller according to the invention. The associated Abbott-Firestone curve $S_{mr}$(c) is plotted in FIG. 4*b*. For this exemplary embodiment, the surface of the casting roller, whose Abbott-Firestone curve is represented in FIG. 2*b*, has been subjected to a grinding with a removal of 35 μm. Due to the grinding, the Abbott-Firestone curve exhibits a flatter course towards small $S_{mr}$ values. Despite the grinding, also the Abbott-Firestone curve of FIG. 4*b* at an area proportion $S_{mr}$ of 10% exhibits a height value c of at least 20 μm above the zero level. In addition, the variables calculated for the exemplary embodiment of FIG. 2*a/b* have been determined again. An average roughness Ra of 25.6(±4.8) μm, a mean square average roughness value Rq of 30.8(±5.1) μm, a average roughness depth Rz of 92.7(±11.0) μm and a peak count RPc(0.5 μm) of 16.8(±5.1) per cm resulted along the X direction. An average roughness Ra of 25.6(±2.8) μm, a mean square average roughness value Rq of 31.1(±3.1) μm, a mean roughness depth Rz of 93.6(±8.8) μm and a peak count RPc(0.5 μm) of 17.4(±4.5) per cm resulted along the Y direction. A roughness value Sa of 25.6(±2.8) μm resulted.

Due to the grinding, such surfaces are more wear resistant and form a plateau that supports the melt well. At the same time, the essential structural properties are retained such that the surface in particular has deep pockets, which reduce the contact area. The peak count RPc and the roughness value Sa remain substantially unchanged within the measurement uncertainties despite the grinding. The bearing proportions form an isotropic net-shaped structure, as resulting from the 3D surface measurements and indicated by the only slight deviations of RPc in the X and Y direction.

Figure 5A:
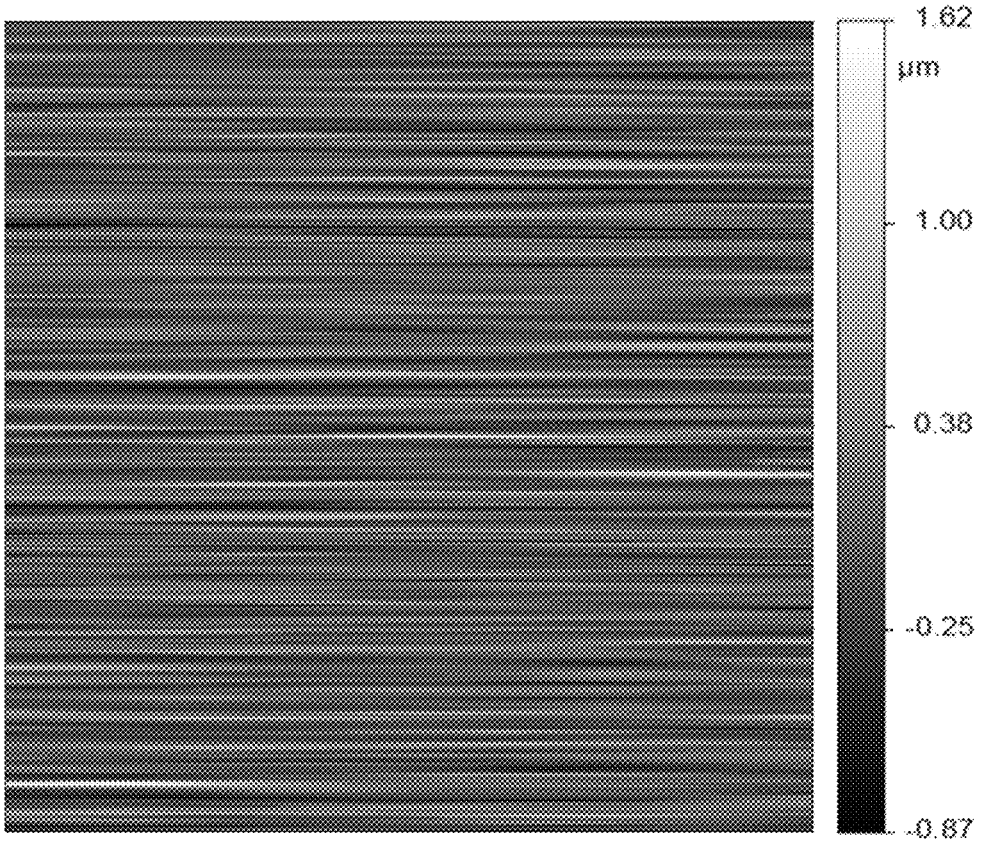
FIG. 5*a* is surface section of a comparative example of a casting roller not according to the invention.
Figure 5B:
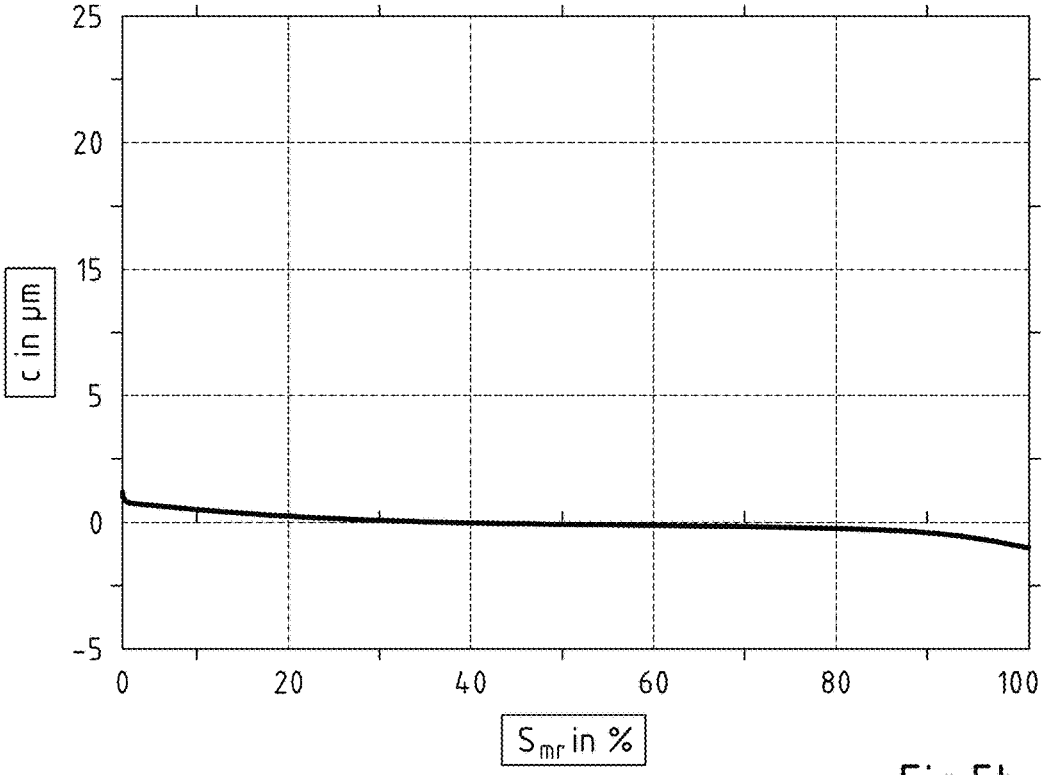
FIG. 5*b* is an Abbott-Firestone curve of the surface of a comparative example of a casting roller not according to the invention.

For a comparative test, a strip made of an AA8111 alloy was cast using a casting roller with copper surface not according to the invention. FIG. 5*a* again shows a representation of a square measuring region with 7 mm edge length of the surface of the casting roller not according to the invention. The associated Abbott-Firestone curve is plotted in FIG. 5*b*. The surface is non-isotropic with a roughness transversely to the grinding direction of only 0.21(±0.01) μm and longitudinally to the grinding direction of 0.16(±0.08) μm as well as a peak density RPc of 10.3(±3.3) per cm transversely to the grinding direction and 0.0(±0.2) per cm longitudinally to the grinding direction. The mean square average roughness value Rq was 0.2(±0.1) μm longitudinally and 0.3(±0.0) μm transversely to the grinding direction; the average roughness depth Rz was 0.2(±0.1) μm longitudinally and 1.4(±0.1) μm transversely to the grinding direction. As is discernible from FIG. 5*b*, there is also an area proportion $S_{mr}$ of 10% at a height value c of significantly below 20 μm. Poor strip formation properties were exhibited in the comparative test with this casting roller not according to the invention.

By means of the described exemplary embodiments of the casting rollers according to the invention, manufacture of an aluminium alloy strip without release agents can be implemented by means of strip casting. In particular, this eliminates a barrier of the heat flow from the melt or strip shell into the revolving chill mould. This therefore has a direct effect on the possible productivity of the casting system. Furthermore, the use of a release agent, usually as a graphite suspension, can lead to undesirable deposits on the produced strips. This is avoided according to the invention. Nevertheless, the disadvantages of adhesion can be effectively avoided using the means described. Thus, a high-quality aluminium alloy strip can be provided particularly productively.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method, comprising:

contacting an aluminium alloy melt or an oxide layer surrounding an aluminium alloy melt with a surface of a casting roller or belt of a revolving chill mould in a strip casting system;

utilizing the casting roller or belt for manufacturing an aluminium alloy strip from the aluminium alloy melt, wherein the surface of the casting roller or belt has a roughness value Sa of more than 5 μm measured according to DIN-EN-ISO 25178-2:2012 and an average peak count RPc (0.5 μm) of less than 42 $cm^{-1}$ measured according to DIN EN 10049:2005 (application group 1—without further removal of ripple and fine roughness proportions).

2. The method according to claim 1, wherein the surface of the casting roller or belt has a roughness value Sa of more than 15 μm measured according to DIN-EN-ISO 25178-2:2012 and/or an average peak count RPc (0.5 μm) of less than 35 $cm^{-1}$ measured according to DIN EN 10049:2005 (application group 1—without further removal of ripple and fine roughness proportions).

3. The method according to claim 1, wherein the surface of the casting roller or belt has a surface structure which, in an Abbott-Firestone curve, at an area proportion $S_{mr}$ of 10% has a first height value c of at least 20 μm above a zero level measured according to DIN-EN-ISO 25178-2:2012, wherein the zero level is defined as a second height value at an area proportion of 50%.

4. The method according to claim 1, wherein the surface of the casting roller or belt has a roughness value Sa of 5 to 40 μm measured according to DIN-EN-ISO 25178-2:2012.

5. The method according to claim 1, wherein the surface of the casting roller or belt is substantially isotropic in terms of peak count and a ratio RPc in the X direction to RPc in the Y direction, measured according to DIN EN 10049:2005 (application group 1—without further removal of the ripple and fine roughness proportions), has the value 1±5%, wherein the X direction and Y direction are perpendicular to one another.

6. The method according to claim 1, wherein the surface of the casting roller or belt has been subjected to a grinding with a removal of up to 45 μm after structuring.

7. The method according to claim 1, wherein in that at least the surface of the casting roller or belt has a material with a thermal conductivity of more than 100 W/(m*K).

8. The method according to claim 1, wherein the surface of the casting roller or belt has a roughness value Sa of 15 to 30 μm measured according to DIN-EN-ISO 25178-2:2012.

9. The method according to claim 1, wherein the surface of the casting roller or belt has a roughness value Sa of 20 to 25 μm measured according to DIN-EN-ISO 25178-2:2012.

10. The method according to claim 1, wherein the surface of the casting roller or belt has been subjected to a grinding with a removal of between 30 and 40 μm after structuring.

11. The method according to claim 1, wherein at least the surface of the casting roller or belt has a material with a thermal conductivity of more than 200 W/(m*K).

12. The method according to claim 1, wherein at least the surface of the casting roller or belt has a material with a thermal conductivity of more than 300 W/(m*K).

13. A method, comprising:

drawing an aluminium alloy melt into a casting gap of at least one revolving chill mould in a strip casting system such that a surface of at least one casting roller or belt of the at least one revolving chill mould contacts the aluminium alloy melt or an oxide layer of the aluminium alloy melt;

casting an aluminium alloy strip from the aluminium alloy melt;

wherein the surface of the at least one casting roller or belt has a roughness value Sa of more than 5 μm measured according to DIN-EN-ISO 25178-2:2012 and an average peak count RPc (0.5 μm) of less than 42 $cm^{-1}$ measured according to DIN EN 10049:2005 (application group 1—without further removal of ripple and fine roughness proportions).

14. The method according to claim 13, wherein the strip casting system has means for setting a composition of an atmosphere on the surface of the at least one revolving chill mould.

15. The method according to claim 13, wherein the strip casting system is a vertical or horizontal strip casting system.

16. The method according to claim 13, wherein the strip casting system comprises means for supplying the aluminium alloy melt into a melt pool formed in front of the casting gap, via which the aluminium alloy melt is supplied to the melt pool below the surface of the melt pool.

17. A method for manufacturing an aluminium alloy strip using a strip casting system comprising at least one revolving chill mould with a casting gap, wherein the at least one revolving chill mould has at least one casting roller or belt, wherein a surface of the at least one casting roller or belt has a roughness value Sa of more than 5 μm measured according to DIN-EN-ISO 25178-2:2012 and an average peak count RPc (0.5 μm) of less than 42 cm-1 measured according to DIN EN 10049:2005 (application group 1—without further removal of ripple and fine roughness proportions), the method comprising the following steps:

forming a melt pool of an aluminium alloy melt in a casting region in front of the at least one revolving chill mould;

stabilising an oxide layer on the surface of the melt pool by applying an oxygen-containing gas mixture to the aluminium alloy melt;

drawing the oxide layer into the casting gap.

18. The method according to claim 17, comprising:

setting a specific area load, when joining strip shells forming during solidification of the aluminium alloy melt, from 10 to 800 KN/m.

19. The method according to claim 17, comprising:

supplying the aluminium alloy melt into the melt pool below the surface of the melt pool.

20. The method according to claim 17, comprising:

setting a specific area load, when joining strip shells forming during solidification of the aluminium alloy melt, from 20 to 400 kN/m.

* * * * *